US005219489A

United States Patent [19]

Swan et al.

[11] Patent Number: 5,219,489

[45] Date of Patent: Jun. 15, 1993

[54] AZEOTROPE-LIKE COMPOSITIONS OF 2-TRIFLUOROMETHYL-1,1,1,2-TETRAFLUOROBUTANE AND METHANOL

[75] Inventors: Ellen L. Swan, Ransomville; Rajat S. Basu, Williamsville; Michael Van Der Puy, Cheektowaga, all of N.Y.

[73] Assignee: Allied-Signal Inc., Morris Township, Morris County, N.J.

[21] Appl. No.: 746,255

[22] Filed: Aug. 15, 1991

[51] Int. Cl.[5] ..... C11D 7/30; C11D 7/50; C23G 5/028

[52] U.S. Cl. ..... 252/171; 134/12; 134/31; 134/38; 134/40; 134/42; 252/153; 252/162; 252/170; 252/364; 252/DIG. 9; 570/134

[58] Field of Search ..... 252/67, 162, 170, 171, 252/172, 305, 364, DIG 9, 153; 134/12, 31, 38, 40, 42; 570/134

[56] References Cited

U.S. PATENT DOCUMENTS

| | | | |
|---|---|---|---|
| 4,842,764 | 6/1989 | Lund et al. | 252/171 |
| 4,947,881 | 8/1990 | Magid et al. | 134/40 |
| 4,970,013 | 11/1990 | Merchant | 252/69 |
| 4,986,928 | 1/1991 | Merchant | 252/171 |
| 4,988,455 | 1/1991 | Magid et al. | 252/171 |
| 5,023,010 | 6/1991 | Merchant | 252/171 |
| 5,034,149 | 7/1991 | Merchant | 252/171 |
| 5,059,728 | 10/1991 | Li et al. | 570/134 |
| 5,073,288 | 12/1991 | Anton | 252/162 |
| 5,073,290 | 12/1991 | Anton et al. | 252/162 |
| 5,076,956 | 12/1991 | Anton | 252/162 |
| 5,087,777 | 2/1992 | Li et al. | 570/136 |

FOREIGN PATENT DOCUMENTS

| | | |
|---|---|---|
| 2009169 | 8/1990 | Canada . |
| 431458 | 6/1991 | European Pat. Off. . |
| 98699 | 4/1989 | Japan . |
| 304194 | 12/1989 | Japan . |

OTHER PUBLICATIONS

Fleming et al. *J.C.S. Perkin I.* 1973 pp. 574–577.

Haszeldine et al. *J. Chem Soc.* (Perkin Transactions) 1979.

*Primary Examiner*—Linda Skaling

*Attorney, Agent, or Firm*—Melanie L. Brown; Jay P. Friedenson; Darryl L. Webster

[57] ABSTRACT

Azeotrope-like compositions comprising 2-trifluoromethyl-1,1,1,2-tetrafluorobutane and methanol are stable and have utility as degreasing agents and as solvents in a variety of industrial cleaning applications including cold cleaning and defluxing of printed circuit boards and dry cleaning.

12 Claims, No Drawings

AZEOTROPE-LIKE COMPOSITIONS OF 2-TRIFLUOROMETHYL-1,1,1,2-TETRAFLUOROBUTANE AND METHANOL

FIELD OF THE INVENTION

This invention relates to azeotrope-like mixtures of 2-trifluoromethyl-1,1,1,2-tetrafluorobutane and methanol. These mixtures are useful in a variety of vapor degreasing, cold cleaning and solvent cleaning applications including defluxing and dry cleaning and aerosol applications.

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al. in U.S. Pat. No. 3,085,918 disclose such suitable vapor degreasers comprising a boiling sump, a clean sump, a water separator, and other ancillary equipment.

Cold cleaning is another application where a number of solvents are used. In most cold cleaning applications, the soiled part is either immersed in the fluid or wiped with rags or similar objects soaked in solvents and allowed to air dry.

Fluorocarbon solvents, such as trichlorotrifluoroethane, have attained widespread use in recent years as effective, nontoxic, and nonflammable agents useful in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like.

The art has looked towards azeotrope or azeotrope-like compositions including the desired fluorocarbon components such as trichlorotrifluoroethane which include components which contribute additionally desired characteristics, such as polar functionality, increased solvency power, and stabilizers. Azeotropic or azeotrope-like compositions are desired because they do not fractionate upon boiling. This behavior is desirable because in the previously described vapor degreasing equipment with which these solvents are employed, redistilled material is generated for final rinse-cleaning. Thus, the vapor degreasing system acts as a still. Unless the solvent composition exhibits a constant boiling point, i.e., is azeotrope-like, fractionation will occur and undesirable solvent distribution may act to upset the cleaning and safety of processing. Preferential evaporation of the more volatile components of the solvent mixtures, which would be the case if they were not azeotrope-like, would result in mixtures with changed compositions which may have less desirable properties, such as lower solvency towards soils, less inertness towards metal, plastic or elastomer components, and increased flammability and toxicity.

The art is continually seeking new fluorocarbon based azeotrope-like mixtures which offer alternatives for new and special applications for vapor degreasing and other cleaning applications. Currently, of particular interest, are fluorocarbon based azeotrope-like mixtures which are considered to be stratospherically safe substitutes for presently used fully halogenated chlorofluorocarbons. The latter are suspected of causing environmental problems in connection with the earth's protective ozone layer. Mathematical models have substantiated that hydrofluorocarbons will not adversely affect atmospheric chemistry, being negligible contributors to ozone depletion and to green-house global warming in comparison to the fully halogenated species.

Commonly assigned U.S. Pat. No. 4,842,764 discloses azeotrope-like compositions of 1,1-dichloro-1-fluoroethane and methanol. U.S. Pat. No. 4,970,013 discloses azeotropic mixtures of 2,3-dichloro-1,1,1,3,3-pentatluoropropane and methanol. U.S. Pat. No. 4,986,928 discloses azeotropic mixtures of 1-chloro-1,2,2-tritluorocyclobutane and methanol. Commonly assigned U.S. Pat. No. 4,988,455 discloses azeotrope-like compositions of 1,1-dichloro-1,2,2-trifluoropropane and methanol.

U.S. Pat. No. 5,023,010 discloses azeotropic mixtures of 1,1,1,2,3,3-hexafluoro-3-methoxypropane and methanol. Kokai Patent Publication 98,699 published Apr. 17, 1989 discloses azeotropic mixtures of 1,1-dichloro-2,2,2-trifluoroethane and methanol. Kokai Patent Publication published Dec. 7, 1989 discloses azeotropic mixtures of 1-chloro-2,2,3,3tetrafluoropropane and methanol.

It is an object of this invention to provide novel azeotrope-like compositions based on hydrofluorocarbons which are liquid at room temperature, which will not fractionate substantially under the process of distillation or evaporation, and which are useful as solvents for use in vapor degreasing and other solvent cleaning applications including defluxing applications and dry cleaning.

Another object of the invention is to provide novel environmentally acceptable solvents for use in the aforementioned applications.

Other objects and advantages of the invention will become apparent from the following description.

DESCRIPTION OF THE INVENTION

In accordance with the invention, novel mixtures have been discovered comprising 2-trifluoromethyl-1,1,1,2-tetrafluorobutane and methanol. Also, novel azeotrope-like or constant-boiling compositions have been discovered comprising 2-trifluoromethyl-1,1,1,2-tetrafluorobutane and methanol.

Preferably, the novel azeotrope-like compositions comprise effective amounts of 2-trifluoromethyl-1,1,1,2-tetrafluorobutane and methanol. The term "effective amounts" as used herein means the amount of each component which upon combination with the other component, results in the formation of the present azeotrope-like composition.

Preferably, novel azeotrope-like compositions comprise 2-trifluoromethyl-1,1,1,2-tetrafluorobutane and methanol which boil at about 33.5° C.±about 1.0° C. at 760 mm Hg (101 kPa).

Preferably, novel azeotrope-like compositions comprise from about 70 to about 99.5 weight percent of 2-trifluoromethyl-1,1,1,2-tetrafluorobutane and from about 0.5 to about 30 weight percent of methanol.

Preferably, novel azeotrope-like compositions comprise from about 75 to about 97 weight percent of 2-trifluoromethyl-1,1,1,2-tetrafluorobutane and from about 3 to about 25 weight percent of methanol which boil at about 33.5° C.±about 1.0 ° C. at 760 mm Hg (101 kPa).

More preferably, novel azeotrope-like compositions comprise from about 80 to about 96 weight percent of 2-trifluoromethyl-1,1,1,2-tetrafluorobutane and from about 4 to about 20 weight percent of methanol.

Most preferably, novel azeotrope-like compositions comprise from about 86 to about 94 weight percent of 2-trifluoromethyl-1,1,1,2-tetrafluorobutane and from about 6 to about 14 weight percent of methanol.

All compositions within the indicated ranges, as well as certain compositions outside the indicated ranges, are azeotrope-like, as defined more particularly below.

The precise azeotrope compositions have not been determined but have been ascertained to be within the above ranges. Regardless of where the true azeotropes lie, all compositions with the indicated ranges, as well as certain compositions outside the indicated ranges, are azeotrope-like, as defined more particularly below.

It has been found that these azeotrope-like compositions are on the whole nonflammable liquids, i.e. exhibit no flash point when tested by the Setaflash method ASTM D-3828-87.

From fundamental principles, the thermodynamic state of a fluid is defined by four variables: pressure, temperature, liquid composition and vapor composition, or P-T-X-Y, respectively. An azeotrope is a unique characteristic of a system of two or more components where X and Y are equal at the stated P and T. In practice, this means that the components of a mixture cannot be separated during distillation, and therefore are useful in vapor phase solvent cleaning as described above.

For the purpose of this discussion, azeotrope-like composition is intended to mean that the composition behaves like an azeotrope, i.e. has constant-boiling characteristics or a tendency not to fractionate upon boiling or evaporation. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted with non-azeotrope-like compositions in which during boiling or evaporation, the liquid composition changes to a substantial degree.

Thus, one way to determine whether a candidate mixture is "azeotrope-like" within the meaning of this invention, is to distill a sample thereof under conditions (i.e. resolution—number of plates) which would be expected to separate the mixture into its separate components. If the mixture is non-azeotrope-like, the mixture will fractionate, i.e. separate into its various components with the lowest boiling component distilling off first, and so on. If the mixture is azeotrope-like, some finite amount of a first distillation cut will be obtained which contains all of the mixture components and which is constant-boiling or behaves as a single substance. This phenomenon cannot occur if the mixture is not azeotrope-like, i.e. it does not behave like an azeotrope. Of course, upon distillation of an azeotrope-like composition such as in a vapor degreaser, the true azeotrope will form and tend to concentrate.

It follows from the above that another characteristic of azeotrope-like compositions is that there is a range of compositions containing the same components in varying proportions which are azeotrope-like or constant-boiling. All such compositions are intended to be covered by the term azeotrope-like or constant-boiling as used herein. As an example, it is well known that at differing pressures, the composition of a given azeotrope-like composition will vary at least slightly as does the boiling point of the composition. Thus, an azeotrope-like composition of A and B represents a unique type of relationship but with a variable composition depending on temperature and/or pressure.

As is readily understood by persons skilled in the art, the boiling point of the azeotrope-like composition will vary with the pressure.

In one process embodiment of the invention, the azeotrope-like compositions of the invention may be used to clean solid surfaces by treating said surfaces with said compositions in any manner well known to the art such as by dipping or spraying or use of conventional degreasing apparatus.

The 2-trifluoromethyl-1,1,1,2-tetrafluorobutane of the present azeotrope-like compositions may be prepared by reacting commercially available 4-iodo-2-trifluoromethyl-1,1,1,2-tetrafluorobutane with zinc and hydrogen chloride. The methanol component of the novel solvent azeotrope-like compositions of the invention is a known material and is commercially available.

It should be understood that the present compositions may include additional components so as to form new azeotrope-like or constant-boiling compositions. Any such compositions are considered to be within the scope of the present invention as long as the compositions are constant-boiling or essentially constant-boiling and contain all of the essential components described herein.

The present compounds are useful as solvents for use in vapor degreasing and other solvent cleaning applications including defluxing, cold cleaning, dry cleaning, dewatering, decontamination, spot cleaning, aerosol propelled rework, extraction, particle removal, and surfactant cleaning applications. These compounds are also useful as blowing agents, Rankine cycle and absorption refrigerants, power fluids, and especially as refrigerants for centrifugal refrigeration chillers.

The present invention is more fully illustrated by the following non-limiting Examples.

EXAMPLE 1

This Example is directed to the preparation of 2-trifluoromethyl-1,1,1,2-tetrafluorobutane.

A 500 milliliter flask fitted with a mechanical stirrer, distillation column, and take-off head was charged with 15 grams (0.046 mole) of commercially available 4-iodo- 2-trifluoromethyl-1,1,1,2-tetrafluorobutane, 28.5 grams (0.45 mole) zinc dust, and 230 milliliters of 10% hydrogen chloride. The mixture was stirred and heated to 50° C. and 7.4 grams (80% yield) of distillate (boiling point 37° C.-39° C.) was collected. 1H NMR ($CDCl_3$): 2.1 (m, 2H), 1.2 (t, 3 H) ppm.

EXAMPLE 2

A microebulliometer which consisted of a 15 milliliter round bottom double neck flask containing a magnetic stirbar and heated with an electrical heating mantel was used. Three milliliters of 2-trifluoromethyl-1,1,1,2-tetrafluorobutane was charged into the microebulliometer and methanol was added in small measured increments by an automated syringe capable of injecting microliters. The temperature was measured using a platinum resistance thermometer and barometric pressure was measured. An approximate correction to the boiling point was done to obtain the boiling point at 760 mm Hg.

The following Table I shows the boiling point measurements, corrected to 760 mm Hg (101 kPa), for various mixtures of 2-trifluoromethyl-1,1,1,2-tetrafluorobutane and methanol. From about 6.5 to about 25 weight percent methanol as shown in Table I, the boiling point of the composition changed by only 1° C. Therefore, the composition behaves as a constant-boiling composition over this range.

TABLE I

| Liquid Mixture | | |
|---|---|---|
| Parts by weight % (CF3)2CFCH2CH3 | Parts by weight % Methanol | Boiling Point @ 760 mmHg (101kPa) |
| 100.00 | 0 | 37.0 |
| 97.28 | 2.72 | 36.3 |
| 95.72 | 4.28 | 35.1 |
| 94.70 | 5.30 | 34.6 |
| 93.71 | 6.29 | 34.1 |
| 92.00 | 8.00 | 33.0 |
| 90.00 | 10.00 | 32.8 |
| 86.70 | 13.30 | 32.6 |
| 75.40 | 24.60 | 32.8 |

EXAMPLE 3

Performance studies are conducted wherein metal coupons are cleaned using the present azeotrope-like compositions as solvents. The metal coupons are soiled with various types of oils and heated to 93° C. so as to partially simulate the temperature attained while machining and grinding in the presence of these oils.

The metal coupons thus treated are degreased in a small test tube with cooling coils around the lip. This test is expected to simulate the liquid wash and vapor rinse by a solvent as done in a typical vapor degreaser. Solvent is boiled in a test tube and it condenses in the cooling coils around its lip and drips back to the test tube. Small coupons of the size of 1 centimeter by 3 centimeters are soiled and may be cleaned by vapor rinse or direct liquid immersion in the solvent.

The metal coupons are held in the solvent vapor and then vapor rinsed for a period of 15 seconds to 2 minutes depending upon the oils selected. The azeotrope-like composition of Example 2 is used as the solvent.

Solubility measurements are done and the solvent azeotropic blend is found to have high solubility of hydrocarbons indicating that this will be a good degreasing solvent. Cleanliness testing of coupons is done by observing the coupons visually.

Inhibitors may be added to the present azeotrope-like compositions to inhibit decomposition of the compositions; react with undesirable decomposition products of the compositions; and/or prevent corrosion of metal surfaces. Any or all of the following classes of inhibitors may be employed in the invention: alkanols having 4 to 7 carbon atoms, nitroalkanes having 1 to 3 carbon atoms, 1,2-epoxyalkanes having 2 to 7 carbon atoms, phosphite esters having 12 to 30 carbon atoms, ethers having 3 or 4 carbon atoms, unsaturated compounds having 4 to 6 carbon atoms, acetals having 4 to 7 carbon atoms, ketones having 3 to 5 carbon atoms, and amines having 6 to 8 carbon atoms. Other suitable inhibitors will readily occur to those skilled in the art.

Examples of useful alkanols having 4 to 7 carbon atoms are 2-methyl-2-propanol; 2-methyl-2-butanol; 1-pentanol; 2-pentanol; 3-pentanol; and 3-ethyl-3-pentanol. The preferred alkanols are 2-methyl-2-propanol and 3-pentanol.

Examples of useful nitroalkanes having 1 to 3 carbon atoms include nitromethane, nitroethane, 1-nitropropane, and 2-nitropropane. The preferred nitroalkanes are nitromethane and nitroethane.

Examples of useful 2,3-epoxybutane having 2 to 7 carbon atoms include epoxyethane; 1,2-epoxypropane; 1,2-epoxybutane; 1,2-epoxypentane; 1,2-epoxyhexane; and 1,2-epoxyheptane. The preferred 1,2-epoxyalkanes are 1,2-epoxybutane and 1,2-epoxypropane.

Examples of useful phosphite esters having 12 to 30 carbon atoms include diphenyl phosphite; triphenyl phosphite; triisodecyl phosphite; triisooctyl phosphite; and diisooctyl phosphite. The preferred phosphite esters are triisodecyl phosphite and triisooctyl phosphite.

Examples of useful ethers having 3 or 4 carbon atoms include diethylene oxide; 1,2-butylene oxide; 2,3-butylene oxide; and dimethoxymethane. The preferred ethers are diethylene oxide and dimethoxymethane.

Examples of useful unsaturated compounds having 4 to 6 carbon atoms include 1,4-butyne diol; 1,5-pentyne diol; and 1,6-hexyne diol. The preferred unsaturated compounds are 1,4-butyne diol and 1,5-pentyne diol.

Examples of useful acetals having 4 to 7 carbon atoms include dimethoxyethane; 1,1-diethyoxyethane; and dipropoxymethane. The preferred acetals are dimethoxyethane and dipropoxymethane.

Examples of useful ketones having 3 to 5 carbon atoms include 2-propanone; 2-butanone; and 3-pentanone. The preferred ketones are 2-propanone and 2-butanone.

Examples of useful amines having 6 to 8 carbon atoms include triethyl amine, dipropyl amine, and diisobutyl amine. The preferred amines are triethyl amine and dipropyl amine.

Having described the invention in detail and by reference to preferred embodiments thereof, it will be apparent that modifications and variations are possible without departing from the scope of the invention defined in the appended claims.

What is claimed is:

1. Azeotrope-like compositions consisting essentially of from about 70 to about 96 weight percent of 2-trifluoromethyl-1,1,1,2-tetrafluorobutane and from about 4 to about 30 weight percent of methanol which boil at about 33.5° C.±about 1.0° C. at 760 mm Hg, wherein the azeotrope-like components consist of said 2-trifluoromethyl-1,1,1,2-tetrafluorobutane and methanol.

2. The azeotrope-like compositions of claim 1 consisting essentially of from about 75 to about 96 weight percent said 2-trifluoromethyl-1,1,1,2-tetrafluorobutane and from about 4 to about 25 weight percent said methanol.

3. The azeotrope-like compositions of claim 1 consisting essentially of from about 80 to about 96 weight percent said 2-trifluoromethyl-1,1,1,2-tetrafluorobutane and from about 4 to about 20 weight percent said methanol.

4. The azeotrope-like compositions of claim 1 consisting essentially of from about 86 to about 94 weight percent said 2-trifluoromethyl-1,1,1,2-tetrafluorobutane and from about 6 to about 14 weight percent said methanol.

5. The azeotrope-like compositions of claim 1 wherein an inhibitor is present in an amount sufficient to inhibit decomposition of the azeotrope-like compositions and selected from the group consisting of alkanols having 4 to 7 carbon atoms, nitroalkanes having 1 to 3 carbon atoms, epoxyethane, 1,2-epoxyalkanes having 5 to 7 carbon atoms, phosphite esters having 12 to 30 carbon atoms, ethers having 3 or 4 carbon atoms, unsaturated diol compounds having 4 to 6 carbon atoms, acetals having 4 to 7 carbon atoms, ketones having 3 to 5 carbon atoms, and amines having 6 to 8 carbon atoms.

6. The azeotrope-like compositions of claim 2 wherein contain an inhibitor is present in an amount sufficient to inhibit decomposition of the azeotrope-like compositions and selected from the group consisting of alkanols having 4 to 7 carbon atoms, nitroalkanes having 1 to 3 carbon atoms, epoxyethane, 1,2-epoxyalkanes having 5 to 7 carbon atoms, phosphite esters having 12 to 30 carbon atoms, ethers having 3 or 4 carbon atoms, unsaturated diol compounds having 4 to 6 carbon atoms, acetals having 4 to 7 carbon atoms, ketones having 3 to 5 carbon atoms, and amines having 6 to 8 carbon atoms.

7. The azeotrope-like compositions of claim 3 wherein contain an inhibitor is present in an amount sufficient to inhibit decomposition of the azeotrope-like compositions and selected from the group consisting of alkanols having 4 to 7 carbon atoms, nitroalkanes having 1 to 3 carbon atoms, epoxyethane, 1,2-epoxyalkanes having 5 to 7 carbon atoms, phosphite esters having 12 to 30 carbon atoms, ethers having 3 or 4 carbon atoms, unsaturated diol compounds having 4 to 6 carbon atoms, acetals having 4 to 7 carbon atoms, ketones having 3 to 5 carbon atoms, and amines having 6 to 8 carbon atoms.

8. The azeotrope-like compositions of claim 4 wherein contain an inhibitor is present in an amount sufficient to inhibit decomposition of the azeotrope-like compositions and selected from the group consisting of alkanols having 4 to 7 carbon atoms, nitroalkanes having 1 to 3 carbon atoms, epoxyethane, 1,2-epoxyalkanes having 5 to 7 carbon atoms, phosphite esters having 12 to 30 carbon atoms, ethers having 3 or 4 carbon atoms, unsaturated diol compounds having 4 to 6 carbon atoms, acetals having 4 to 7 carbon atoms, ketones having 3 to 5 carbon atoms, and amines having 6 to 8 carbon atoms.

9. A method of cleaning a solid surface which comprises treating said surface with said azeotrope-like composition as defined in claim 1.

10. A method of cleaning a solid surface which comprises treating said surface with said azeotrope-like composition as defined in claim 2.

11. A method of cleaning a solid surface which comprises treating said surface with said azeotrope-like composition as defined in claim 3.

12. A method of cleaning a solid surface which comprises treating said surface with said azeotrope-like composition as defined in claim 4.

* * * * *